US005270142A

United States Patent [19]

Snelling

[11] Patent Number: 5,270,142

[45] Date of Patent: Dec. 14, 1993

[54] PHOTO-ERASABLE IONOGRAPHIC RECEPTOR

[75] Inventor: Christopher Snelling, Penfield, N.Y.

[73] Assignee: Xerox Corporation, Stamford, Conn.

[21] Appl. No.: 544,383

[22] Filed: Jun. 27, 1990

[51] Int. Cl.[5] ..... G03G 5/00

[52] U.S. Cl. ..... 430/78; 430/76; 430/53

[58] Field of Search ..... 430/78, 76, 53

[56] References Cited

U.S. PATENT DOCUMENTS

| | | | |
|---|---|---|---|
| 3,357,989 | 12/1967 | Byrne et al. | 260/314.5 |
| 3,442,781 | 5/1969 | Weinberger | 204/181 |
| 3,816,118 | 6/1974 | Byrne | 430/78 |
| 4,108,655 | 8/1978 | Kropac | 430/40 |
| 4,137,537 | 1/1979 | Takahashi et al. | 346/159 |
| 4,518,468 | 5/1985 | Fotland et al. | 204/38.3 |
| 4,557,868 | 12/1985 | Page et al. | 260/245.89 |
| 4,883,731 | 11/1989 | Tam et al. | 430/41 |
| 5,012,291 | 4/1991 | Buchan et al. | 355/271 |
| 5,039,598 | 8/1991 | Abramsohn et al. | 430/53 |
| 5,103,263 | 4/1992 | Moore et al. | 430/66 |

*Primary Examiner*—Marion E. McCamish
*Assistant Examiner*—Mark A. Chapman
*Attorney, Agent, or Firm*—Oliff & Berridge

[57] ABSTRACT

An ionographic imaging member having a conductive layer and a charge accepting layer, wherein the charge accepting layer is sufficiently photosensitive to provide erasure of residual charge in the member by exposure to light.

10 Claims, 1 Drawing Sheet

PHOTO-ERASABLE IONOGRAPHIC RECEPTOR

BACKGROUND OF THE INVENTION

This invention is directed generally to ionography, and more specifically, to electroreceptors for ionographic imaging.

In ionography, latent images are formed by depositing ions in a prescribed pattern onto an electroreceptor surface. The ions may be applied by a linear array of ion emitting devices or ion heads, creating a latent electrostatic image. Alternatively, the electroreceptor surface may be charged to a uniform polarity, and portions discharged with an opposite polarity to form a latent image. Charged toner particles are then passed over these latent images, causing the toner particles to remain where a charge has previously been deposited. This developed image is sequentially transferred to a substrate such as paper, and permanently affixed thereto.

Ionography is, in some respects, similar to the more familiar form of imaging used in electrophotography. However, the two types of imaging are fundamentally different. In electrophotography, an electrophotographic plate containing a photoconductive insulating layer on a conductive layer is imaged by first uniformly electrostatically charging its surface. The plate is then exposed to a pattern of activating electromagnetic radiation such as light. The electrophotographic plate is insulating in the dark and conductive in light. The radiation therefore selectively dissipates the charge in the illuminated areas of the photoconductive insulating layer while leaving behind an electrostatic latent image in the non-illuminated areas. Thus, charge is permitted to flow through the imaging member. The electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reuseable photoconductive insulating layers.

Ionographic imaging members differ in many respects from the above-described and other electrophotographic imaging members. The imaging member of an ionographic device is electrically insulating so that charge applied thereto does not disappear prior to development. Charge flow through the imaging member is undesirable since charge may become trapped, resulting in a failure of the device. Ionographic receivers possess negligible, if any, photosensitivity. The absence of photosensitivity provides considerable advantages in ionographic applications. For example, the electroreceptor enclosure does not have to be completely impermeable to light, and radiant fusing can be used without having to shield the receptor from stray radiation. Also, the level of charge decay (the loss of surface potential due to charge redistribution or opposite charge recombination) in these ionographic receivers is characteristically low, thus providing a constant voltage profile on the receiver surface over extended time periods.

An advantage of ionography over electrophotography is its elimination of the need for a photoreceptor. In its place, a non-light sensitive dielectric receptor of appropriate dielectric constant and thickness is used to retain the latent electrostatic image formed by controlled ion deposition onto its surface.

After the imaging and development steps in an ionographic imaging process, it is necessary to remove (erase) any remaining charge and/or toner to prepare the electroreceptor for the next imaging cycle. The erase function in dielectric receptors is typically performed by exposing the imaging surface to corona discharge to neutralize any residual charge on the imaging device. Thus, the erase function depends upon the contact with the top surface of the electroreceptor. For example, U.S. Pat. No. 4,137,537 to Takahasi et al discloses an electrostatic transfer process and apparatus wherein image forming areas on an insulating surface of the apparatus are erased by electric discharge from closely spaced pin electrodes.

This erase function of ionographic imaging members is subject to failure. Internal polarization and/or trapped charges can result in failure of the erase function due to dielectric relaxation effects. These problems have been encountered in ionographic printers, for example, manifesting themselves in the form of ghost image artifacts in prints. Further, corona discharge generates ozone and other undesirable effluents.

In electrophotographic systems, on the other hand, the erase function is achieved by photogeneration of copious amounts of charge carriers in the photoreceptor by erase light exposure of a wavelength from about 400 to 800 nanometers. Although residual potential cycle up can occur in electrophotographic imaging members, magnitudes and rates of residual formation are typically much less than the dielectric relaxation potentials observed in some ionographic receptors.

SUMMARY OF THE INVENTION

It is an object of the invention to provide an ionographic imaging member having improved erase functions.

It is an object of the invention to provide an electroreceptor having the capability of generating charge carriers within the electroreceptor in order to achieve internal neutralization of the electroreceptor potential.

It is another object of the invention to provide a simplified erase system designed for an ionographic imaging member which provides erasure by illumination.

It is also an object of the invention to provide an ionographic imaging member which does not generate ozone or other corona effluents generated during erase functions.

It is also an object of the invention to permit precleaning discharge of an electroreceptor in order to enhance cleaning capabilities of the electroreceptor.

These and other objects of the invention are achieved by providing an ionographic imaging member comprising a conductive layer and a dielectric imaging layer, wherein a latent image on the imaging device is erasable upon exposure to light. This photo-erasability is provided by introducing photosensitivity into the ionographic imaging member. Photosensitivity may be introduced into the ionographic imaging member by incorporating a photosensitive material into the dielectric layer of the electroreceptor, preferably in an amount which does not substantially affect the electrographic properties of the electroreceptor. In one specific embodiment, a photosensitive pigment such as phthalocyanine is dispersed in the dielectric imaging layer of the electroreceptor.

BRIEF DESCRIPTION OF THE DRAWINGS

A more complete understanding of the present invention may be obtained by reference to the accompanying drawing, which is a cross-sectional view of an electroreceptor of the invention.

DESCRIPTION OF PREFERRED EMBODIMENTS

Figure 1:
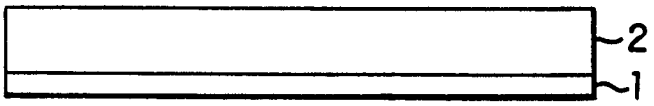

The electroreceptors of the present invention comprise an electrically conductive layer and a charge accepting layer (dielectric imaging layer). The electroreceptors are provided with a photosensitive material dispersed in an amount which is sufficient to provide photosensitivity to the electroreceptor necessary to obtain internal neutralization of the electroreceptor potential by illumination.

Illustrated in the drawing is a cross-sectional view of an electroreceptor of the present invention comprising a conductive layer 1 and a dielectric imaging layer 2. Generally, any suitable electrically conductive material may be employed in the conductive layer 1. The conductive layer may comprise, for example, a thin vacuum deposited metal or metal oxide coating, electrically conductive particles dispersed in a binder, or an electrically conductive polymer such as polypyrrole, polythiophenes, or the like. The conductive layer may be self supporting, or may be applied to a supporting substrate. Generally, the conductive layer should be continuous, uniform and have a thickness of between about 0.05 micrometer and about 25 micrometers. Any thickness outside this range also may be utilized, if desired.

Typical metals and metal oxides which may be used in the conductive layer include aluminum, indium, gold, tin oxide, indium tin oxide, antimony tin oxide, silver, nickel, copper iodide, silver paint, and the like. Typical electrically conductive particles that may be dispersed in a binder include carbon black, aluminum, indium, gold, tin oxide, indium tin oxide, silver, nickel, and the like, and mixtures thereof. The particles should have an average particle size that is less than the dry thickness of the conductive layer. Typical film forming binders for conductive particles include polyurethane, polyesters, fluorocarbon polymers, polycarbonates, polyarylethers, polyaryl sulfones, polybutadiene and copolymers with styrene, vinyl/toluene, acrylates, polyether sulfones, polyimides, poly (amide-imides), polyetherimides, polystyrene and acrylonitrile copolymers, polysulfones, polyvinylchloride, and polyvinyl acetate copolymers and terpolymers, silicones, acrylates and copolymers, alkyds, cellulosic resins and polymers, epoxy resins and esters, nylon and other polyamides, phenolic resins, phenylene oxide, polyvinylidene fluoride, polyvinyl fluoride, polybutylene, polycarbonate co-esters, and the like. The relative quantity of conductive particles added to the binder depends to some extent on the conductivity of the particles. Generally, sufficient particles should be added to achieve an electrical resistivity of less than $10^5$ ohms/square for the final dry solid conductive layer.

Conductive coatings are commercially available from many sources. Typical conductive coating compositions include Red Spot® Olefin conductive primer (available from Red Spot Paint & Varnish Co. , Inc. ), Aquadag Alcodag and other "Dag" coatings (available from Acheson Colloids Co.), LE12644 (available from Red Spot Paint & Varnish Co. , Inc. Polane® E67BC24, E75BC23, E67BC17 (available from Sherwin Williams Chemical Coatings), ECP-117 polypyrrole polymer (available from Polaroid Corp.), and the like.

If desired, any suitable solvent may be employed with the film forming binder polymer material to facilitate application of the electrically conductive layer. The solvent should dissolve the film forming binder polymer of the conductive layer. Typical combinations of film forming binder polymer materials and solvents or combinations of solvents include polycarbonate (Lexan 4701 available from General Electric Co.) and dichloromethane/1,1,2-trichloroethane, copolyester (Vitel® PE100, available from Goodyear Tire & Rubber Co.) and dichloromethane/1,1,2-trichloroethane, polyester (du Pont 49000, available from E. I. du Pont de Nemours & Co.) and dichloromethane/1,1,2-trichloroethane, polyacrylic (dupont Acrylic 68070 available from E. I. du Pont De Nemours & Co.) and aromatic hydrocarbons, polyurethane (Estane® 5707FIP, available from B. F. Goodrich Chemical Co.) and tetrahydrofuran/ketone blend, ECP-117 polypyrrole available from Polaroid Corp and alcohols, esters, acetic acid, dimethyl formamide, alone and in blends, and the like.

The dielectric imaging layer 2 of the invention preferably comprises a material having a high dielectric constant. Such materials may be pigmented with a dielectric pigment to increase the dielectric constant. Suitable dielectric materials include polyvinyl fluoride (PVF), available as Tedlar from du Pont, polyvinylidene fluoride, available as Kynar from Pennwalt, and mixtures of insulating resins with high dielectric constant pigments. Dielectric pigments include inorganic materials. Typical inorganic materials include ceramics, aluminum oxide, titanium dioxide, zinc oxide, barium oxide, glasses, magnesium oxide and the like.

The dielectric imaging layer may also contain any suitable dissolved or dispersed materials. These dissolved or dispersed materials may include, for example, inorganic materials such as barium titanate, transition metal oxides of iron, titanium, vanadium, manganese, or nickel, phosphate glass particles and the like.

One specific class of dispersed materials is obtained from the transition metal oxides by making use of their property of multiple valency. Transition metal phosphate glasses may be obtained by mixing and subsequently melting sufficient quantities of the transition metal oxides with phosphorous pentoxide. This process creates a glass with predetermined dielectric properties in which a desired composite material dielectric constant can be obtained in a predictable manner. One example of such a glass is $4.5TiO_{2-x}.2P_2O_5$, where x determines the ratio of the two valence states of Ti. The larger the x the more $Ti^{3+}$ ion is present. The ratio of $Ti^{3+}$ to $Ti^{4+}$ determines the dielectric properties of the glass. Thus, the smaller the value of x, the smaller the value of the DC dielectric constant. Such a glass may be produced by first obtaining an appropriate $TiO_2$—$P_2O_5$ mixture by heating a calculated mix of powdered $TiO_2$ and $(NH_4)_2HPO_4$ in an argon atmosphere. This mixture is doped as required with $Ti_2O_3$. After thorough mixing, the resultant powder is heated in an argon atmosphere until it melts. It is maintained in a molten state for a period of about 1 hour and then cast by pouring directly from the melt. Alternatively, the glass may be shotted by conventional means. A value of $x=0.05$ yields a static dielectric constant of about 20 and a high frequency dielectric constant of about 6. Values in this range are easily achieved with all the transition metal oxides. Values as high as 100 can be obtained for the static dielectric constant. Once formed, the glass is ground or otherwise processed into fine particles for use in the electroreceptor of a desired dielectric constant. In preparing the transition metal phosphate glasses, other transition metals such as V, Mn, Ni, Fe and the like may be substituted for Ti in the above formula. The values in front of the oxide and the pentoxide may also be varied. Thus, with the pentoxide value fixed, the other value may be varied from 2.5 to 6 to achieve a glass. These materials are humidity insensitive, tough, vary in transparency from clear at $x=0$ to smoky for $x=0.1$, and are nontoxic in that they are inert in this form.

It should also be appreciated that numerous other dielectric materials are listed in the Handbook of Chemistry and Physics, 66th Ed. 1985–1986, CRC Press, Inc., Section E, pages 49–59, and elsewhere which are potentially useful in dielectric imaging layers (electroreceptors), and their selection is easily achieved once the desired conditions stated above are recognized.

Insulating resins which may be doped with high dielectric constant pigments include polyurethanes and other materials, such as those film forming binder polymers described above for the conductive layer. High dielectric constant pigments include, for example, $TiO_2$ and $BaTiO_3$. When mixtures of insulating resins high dielectric constant pigments are used, it is preferred that a composition with a dielectric constant of at least about 5 is obtained. However, dielectric materials having a dielectric constant less than about 5 may also be used, if desired.

The dielectic imaging layer of the present invention may also be provided by anodizing an aluminum or aluminum alloy member, dehydrating the anodic oxide surface layer, followed by impregnating surface pores with a dielectric wax, as disclosed in U.S. Pat. No. 4,518,468, incorporated herein.

In the above-described dielectric imaging layers, a photoresponsive or photosensitive material is dispersed.

Examples of photosensitive materials which may be dispersed in the dielectric material of the dielectric imaging layer include inorganic photoconductive particles such as amorphous selenium; trigonal selenium; and selenium alloys selected from the group consisting of selenium-tellurium, selenium-tellurium-arsenic, selenium arsenide; and phthalocyanine pigments such as the X-form of metal-free phthalocyanine described in U.S. Pat. No. 3,357,989, metal phthalocyanines such as vanadyl phthalocyanine and copper phthalocyanine; dibromoanthanthrone; squarylium; quinacridones available from du Pont under the tradename Monastral Red, Monastral Violet and Monastral Red Y; Vat orange 1 and Vat orange 3 (trade names for dibromo anthanthrone pigments); benzimidazole perylene; substituted 2,4-diaminotriazines disclosed in U.S. Pat. No. 3,442,781; polynuclear aromatic quinones available from Allied Chemical Corporation under the tradename Indofast Double Scarlet, Indofast Violet Lake B, Indofast Brilliant Scarlet and indofast Orange; and the like. Other suitable photogenerating materials known in the electrophotographic imaging art may also be utilized, if desired. Dielectric imaging layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infrared light.

Any organic polymer which can be complexed to form at least a weakly photoconductive material (i.e., a material which is just sufficiently capable of achieving erasure through light exposure) may be used in the present invention. Further, inorganic material based electroreceptors such as amorphous silicon may be utilized, provided the materials are designed to have the required photosensitivity to achieve the desired erase function.

The photogenerating material may be present in the dielectric layer in various amounts. Preferably, the photosensitive material is present in an amount just sufficient to provide an erase function. Generally, a few percent by volume of a photogenerating pigment may be dispersed in the dielectric material. For example, 10 percent by volume or less, 5 percent by volume or less, or 3 percent by volume or less, of a photogenerating pigment may be dispersed in the dielectric material. The volume percent used will depend upon various factors, including the type of photogenerating pigment used, the photosensitivity of the material, and the like. It is important to recognize that attainment of the erase function is not dependent upon attainment of either the level of photosensitivity or the spectral response characteristics required for electrophotographic imaging members. Direct erase illumination (i.e., no lens) over an extended zone (i.e., no narrow exposure slit) offers several orders of magnitude greater exposure energy for erase exposure. Therefore, photosensitivity can be several orders of magnitude less than that required for an electrophotographic imaging member. Illumination with light having a wavelength between about 300 nanometers and about 10 micrometers is sufficient to achieve erasure in the present invention. A low level of photosensitivity is preferred in the present invention to minimize the need to shield the electroreceptor from stray light exposure. Spectral response characteristics, normally an issue with electrophotographic imaging members to assure color capability, need only be approximately related to the erase light source output.

The dielectric imaging layer of the invention may range in thickness from about 10 micrometers to about 100 micrometers. Thicknesses outside these ranges can be selected, providing the objectives of the present invention are achieved.

Any suitable and conventional technique may be utilized to mix and thereafter apply the photo-erasable dielectric layer coating mixture to the conductive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating. Vacuum deposition may also be used to apply to the layer, provided the materials can be vacuum deposited.

In one particular embodiment of the present invention, an electroreceptor is provided as disclosed in U.S. Pat. No. 4,518,468, discussed above. In other words, an electroreceptor comprising an anodized surface of an aluminum or aluminum alloy member is provided having surface pores which are impregnated with a dielectric wax. The dielectric wax may be any of various dielectric waxes such as carnauba wax, montan wax, or waxes modified with resins or additives for enhanced dielectric properties. Various paraffins and other petroleum-derived waxes, beeswax, and candelilla wax may also be used, but are less preferred. In addition to the materials for the electroreceptor described in U.S. Pat. No. 4,518,468, a photosensitive material is provided dispersed in the dielectric wax. For example, a few percent by volume of phthalocyanine is dispersed in the wax. The phthalocyanine renders the dielectric layer photosensitive so that erasure may be achieved through light exposure (illumination). Thus, the elimination of the corona erase mechanism and corona chemistry eliminates ghost images through the bulk of the electroreceptor.

The present invention thus provides improved erase functions by virtue of the ability to generate charge carriers within the electroreceptor to achieve internal, rather than merely top surface, neutralization of electroreceptor potential. Further, a simplified erase system design is provided since a simple illumination source of adequate intensity replaces the corona contact means normally used to erase ionographic electroreceptors by top surface contact. In addition to eliminating the critical design and adjustments necessary for top surface corona contact erasure, the associated generation of ozone and other corona effluents by such erase systems is eliminated. Yet an additional advantage of the present invention is that the electroreceptor may be provided with a precleaning discharge for enhancing cleaning.

While the invention has been described with reference to particular preferred embodiments, the invention is not limited to the specific examples given, and other embodiments and modifications can be made by those skilled in the art without departing from the spirit and scope of the invention.

What is claimed is:

1. An ionographic imaging member, comprising a conductive layer and a charge accepting layer, said charge accepting layer comprising a photoconductive material dispersed in a dielectric material, said photoconductive material being present in an amount of 10 percent by volume or less, wherein a latent image formed by applying ions in a prescribed pattern onto said charge accepting layer of said imaging member is erasable by exposure to light having a wavelength between about 300 nanometers and about 10 micrometers.

2. The member of claim 1, wherein said dielectric material is wax.

3. The member of claim 1, wherein the dielectric material is selected from the group consisting of anodized aluminum and aluminum alloy.

4. The member of claim 1, wherein said photoconductive material is phthalocyanine pigment.

5. An ionographic imaging member, comprising a conductive layer having a contiguous oxide surface layer having a plurality of pores, wherein said pores are impregnated with wax containing dispersed photoconductive material, said photoconductive material being present in an amount of 10% by volume or less, wherein a latent image formed by applying ions in a prescribed pattern onto said contiguous oxide surface layer of said imaging member is erasable by exposure to light having a wavelength between about 300 nanometers and about 10 micrometers.

6. The member of claim 5, wherein said wax is carnauba wax.

7. The member of claim 5, wherein said photoconductive material is phthalocyanine pigment.

8. A method of ionographic imaging, comprising the steps of:

providing an ionographic imaging member comprising a charge accepting layer on a conductive layer, said charge accepting layer having photoconductive material dispersed therein;

forming a latent image on said charge accepting layer by depositing ions onto its surface;

developing said latent image; and erasing residual charge in said charge accepting layer by exposing said layer to light.

9. The method of claim 8, wherein said light has a wavelength from about 300 nanometers to about 10 micrometers.

10. The method of claim 8, further comprising the step of cleaning said charge accepting layer after said erasing step.

* * * * *